US011352903B2

(12) United States Patent
Pratt et al.

(10) Patent No.: US 11,352,903 B2
(45) Date of Patent: Jun. 7, 2022

(54) ROTOR STACK BUSHING WITH ADAPTIVE TEMPERATURE METERING FOR A GAS TURBINE ENGINE

(71) Applicant: United Technologies Corporation, Farmington, CT (US)

(72) Inventors: William S. Pratt, West Hartford, CT (US); Matthew E. Bintz, West Hartford, CT (US); Weston Behling, Norwalk, CT (US); Kevin N. McCusker, West Hartford, CT (US); Erica J. Harvie, Middletown, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 104 days.

(21) Appl. No.: 16/747,065

(22) Filed: Jan. 20, 2020

(65) Prior Publication Data

US 2021/0222580 A1 Jul. 22, 2021

(51) Int. Cl.
*F01D 25/12* (2006.01)

(52) U.S. Cl.
CPC ..... *F01D 25/125* (2013.01); *F01D 25/12* (2013.01)

(58) Field of Classification Search
CPC ..... F04D 29/046; F04D 19/02; F04D 29/644; F16C 27/02; F16C 35/02; F16C 2360/44;
(Continued)

(56) References Cited

U.S. PATENT DOCUMENTS 3,186,287 A * 6/1965 Wehlau ..... F16C 33/18 84/251
4,184,797 A * 1/1980 Anderson ..... F01D 5/087 416/95

(Continued)

FOREIGN PATENT DOCUMENTS

CN 106194828 A 12/2016
DE 3606597 C1 2/1987

(Continued)

OTHER PUBLICATIONS

EP Search Report dated Mar. 17, 2021 issued for corresponding European Patent Application No. 20209031.2.

*Primary Examiner* — Michael Lebentritt
*Assistant Examiner* — Brian Christopher Delrue
(74) *Attorney, Agent, or Firm* — Bachman & LaPointe, P.C.

(57) ABSTRACT

A rotor stack for a gas turbine engine includes a first rotor disk with a first rotor spacer arm, the first rotor spacer arm having a first flange with an outboard flange surface and an inboard flange surface, a first hole along an axis through the first flange, the first hole having a counterbore in the outboard flange surface; a second rotor disk with a web having a second hole along the axis; a third rotor disk with a third rotor spacer arm, the third rotor spacer arm having a third flange with an outboard flange surface and an inboard flange surface, a third hole along the axis through the third flange, the third hole having a counterbore in the inboard flange surface; and a bushing with a tubular body and a flange that extends therefrom, the tubular body comprising at least one axial groove along an outer diameter thereof, the bushing extends through the first hole, the second hole and partially into the counterbore in the inboard flange surface of the third hole.

10 Claims, 5 Drawing Sheets

(58) Field of Classification Search
CPC ..... F16C 2360/23; Y10T 403/25; Y10T 403/255; F01D 25/125; F01D 25/12; F01D 5/085
See application file for complete search history.

(56) References Cited

U.S. PATENT DOCUMENTS

| | | | | |
|---|---|---|---|---|
| 4,795,307 | A | 1/1989 | Liebl | |
| 5,072,785 | A * | 12/1991 | Dressler | F01D 25/243 165/47 |
| 5,472,313 | A | 12/1995 | Quinones et al. | |
| 5,492,447 | A * | 2/1996 | Mannava | F01D 5/3092 415/200 |
| 5,593,274 | A | 1/1997 | Carreno et al. | |
| 6,428,272 | B1 * | 8/2002 | Pepi | F01D 5/066 416/96 R |
| 7,922,445 | B1 * | 4/2011 | Pankey | F01D 17/162 415/160 |
| 8,186,939 | B2 * | 5/2012 | Lecuyer | F01D 5/025 415/115 |
| 9,228,495 | B2 * | 1/2016 | Scanlon | F04D 29/321 |
| 10,161,251 | B2 | 12/2018 | Bintz et al. | |
| 10,329,912 | B2 | 6/2019 | Roussely-Rousseau et al. | |
| 10,584,612 | B2 * | 3/2020 | Jones | F04D 29/644 |
| 10,837,284 | B2 * | 11/2020 | Siebel | F01D 5/066 |
| 2017/0335719 | A1 * | 11/2017 | Hendrickson | F16B 31/06 |
| 2019/0063224 | A1 | 2/2019 | Hashimoto et al. | |
| 2019/0203600 | A1 | 7/2019 | Petrasko et al. | |
| 2019/0242407 | A1 | 8/2019 | Giannakopoulos et al. | |

FOREIGN PATENT DOCUMENTS

| | | | |
|---|---|---|---|
| EP | 0735238 | A1 | 10/1996 |
| EP | 1217169 | A2 | 6/2002 |
| EP | 3524777 | A1 | 8/2019 |
| FR | 2406069 | A1 | 5/1979 |

* cited by examiner

ROTOR STACK BUSHING WITH ADAPTIVE TEMPERATURE METERING FOR A GAS TURBINE ENGINE

U.S. GOVERNMENT RIGHTS

This invention was made with Government support awarded by the United States. The Government has certain rights in this invention.

BACKGROUND

The present disclosure relates to a gas turbine engine, and more specifically to a bolted attachment that provides airflow metering through a rotor stack.

Gas turbine engines typically include a compressor section to pressurize airflow, a combustor section to burn a hydrocarbon fuel in the presence of the pressurized air, and a turbine section to extract energy from the resultant hot-side effluent of the combustion gases.

In gas turbine engines, turbine sections require a secondary cooling flow to prevent the hardware from failing due to air temperatures far exceeding their material capability. This flow is sourced from the compressor section, where flow is typically sent below the backbone via "fingernail" cuts in the rotor flanges that are bolted together, allowing air to pass through without structurally compromising the rotor. The axial source position of this air is chosen by evaluating the air pressure required to purge the turbine cavities, but also for an air temperature low enough to cool the turbine parts. The compressor also makes use of this air to mitigate thermal gradients in the compressor rotor disks, and condition the compressor rotor webs and bores to benefit rotor tip clearances and improve compressor efficiency. This type of cooling provides only minimal regulation of temperature differentials in aft stages of the compressor as one air source location may be too hot but moving only half a stage backward or forward can be too cold. This differential in temperature across a single rotor can be upwards of 100 degrees Fahrenheit.

SUMMARY

A rotor stack for a gas turbine engine according to one disclosed non-limiting embodiment of the present disclosure includes a first rotor disk with a first rotor spacer arm, the first rotor spacer arm having a first flange with an outboard flange surface and an inboard flange surface, a first hole along an axis through the first flange; a second rotor disk with a web having a second hole along the axis; a third rotor disk with a third rotor spacer arm, the third rotor spacer arm having a third flange with an outboard flange surface and an inboard flange surface, a third hole along the axis through the third flange; and a bushing with a tubular body and a flange that extends therefrom, the tubular body comprising at least one axial groove along an outer diameter thereof, the bushing extending through the first hole, the second hole, in the inboard flange surface of the third flange.

A further embodiment of any of the foregoing embodiments of the present disclosure includes a fastener that extends through the bushing along the axis.

A further embodiment of any of the foregoing embodiments of the present disclosure includes, a nut threaded to the fastener to sandwich the web between the first flange and the third flange.

A further embodiment of any of the foregoing embodiments of the present disclosure includes the first hole comprises a first counterbore in the outboard flange surface a cold-side groove from an outboard plenum along the inboard flange surface to the first counterbore in the outboard flange surface.

A further embodiment of any of the foregoing embodiments of the present disclosure includes, a hot-side groove along the inboard flange surface to the third counterbore in the inboard flange surface.

A further embodiment of any of the foregoing embodiments of the present disclosure includes a counterbore in the third hole in the inboard flange surface, the bushing extending through the first hole, the second hole, and partially into the counterbore, an output groove along the inboard flange surface from the third counterbore in the inboard flange surface to an inner plenum.

A further embodiment of any of the foregoing embodiments of the present disclosure includes that the hot-side groove and the cold-side groove are sized to provide a predetermined temperature flow to the output groove.

A further embodiment of any of the foregoing embodiments of the present disclosure includes that the hot-side groove provides an airflow that is 100-200 degree F. higher than an airflow from the cold-side groove.

A further embodiment of any of the foregoing embodiments of the present disclosure includes that the hot-side groove provides an airflow that is at a higher pressure than an airflow from the cold-side groove.

A further embodiment of any of the foregoing embodiments of the present disclosure includes, an anti-vortex tube system within the inner plenum.

A further embodiment of any of the foregoing embodiments of the present disclosure includes that the second rotor disk is a pancake disk.

A method of communicating a secondary airflow within a gas turbine engine according to one disclosed non-limiting embodiment of the present disclosure includes communicating a cold-side airflow through a first multiple of grooves between a flange surface of a first rotor disk and a web of a second rotor disk to an axial hole; communicating the cold-side airflow along an outer diameter of a bushing; communicating a hot-side airflow through a second multiple of grooves between a flange surface of a third rotor disk and the web of the second rotor disk to the outer diameter of the bushing; and communicating a mixed airflow from the outer diameter of the bushing to an outlet groove.

A further embodiment of any of the foregoing embodiments of the present disclosure includes that the axial hole extends through the flange surface of the first rotor disk, the web of the second rotor disk, and the flange surface of the third rotor disk along an axis.

A further embodiment of any of the foregoing embodiments of the present disclosure includes that the bushing surrounds the axis.

A further embodiment of any of the foregoing embodiments of the present disclosure includes a fastener through the bushing to sandwich the web between the flange of the first rotor disk and the flange of the third rotor disk.

A further embodiment of any of the foregoing embodiments of the present disclosure includes a flange on the bushing interfacing with a counterbore in the flange of the first rotor disk.

A further embodiment of any of the foregoing embodiments of the present disclosure includes, further comprising a counterbore in the flange surface of the third rotor disk, the bushing spaced from a step surface within the counterbore.

A further embodiment of any of the foregoing embodiments of the present disclosure includes sizing the first multiple of grooves with respect to the second multiple of grooves to provide a desired mixed airflow.

A further embodiment of any of the foregoing embodiments of the present disclosure includes that the outlet groove between the web of the second rotor disk and the flange surface of the third rotor disk.

A further embodiment of any of the foregoing embodiments of the present disclosure includes that the outlet groove between the web of the second rotor disk and the flange surface of the first rotor disk.

The foregoing features and elements may be combined in various combinations without exclusivity, unless expressly indicated otherwise. These features and elements as well as the operation thereof will become more apparent in light of the following description and the accompanying drawings. It should be appreciated; however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
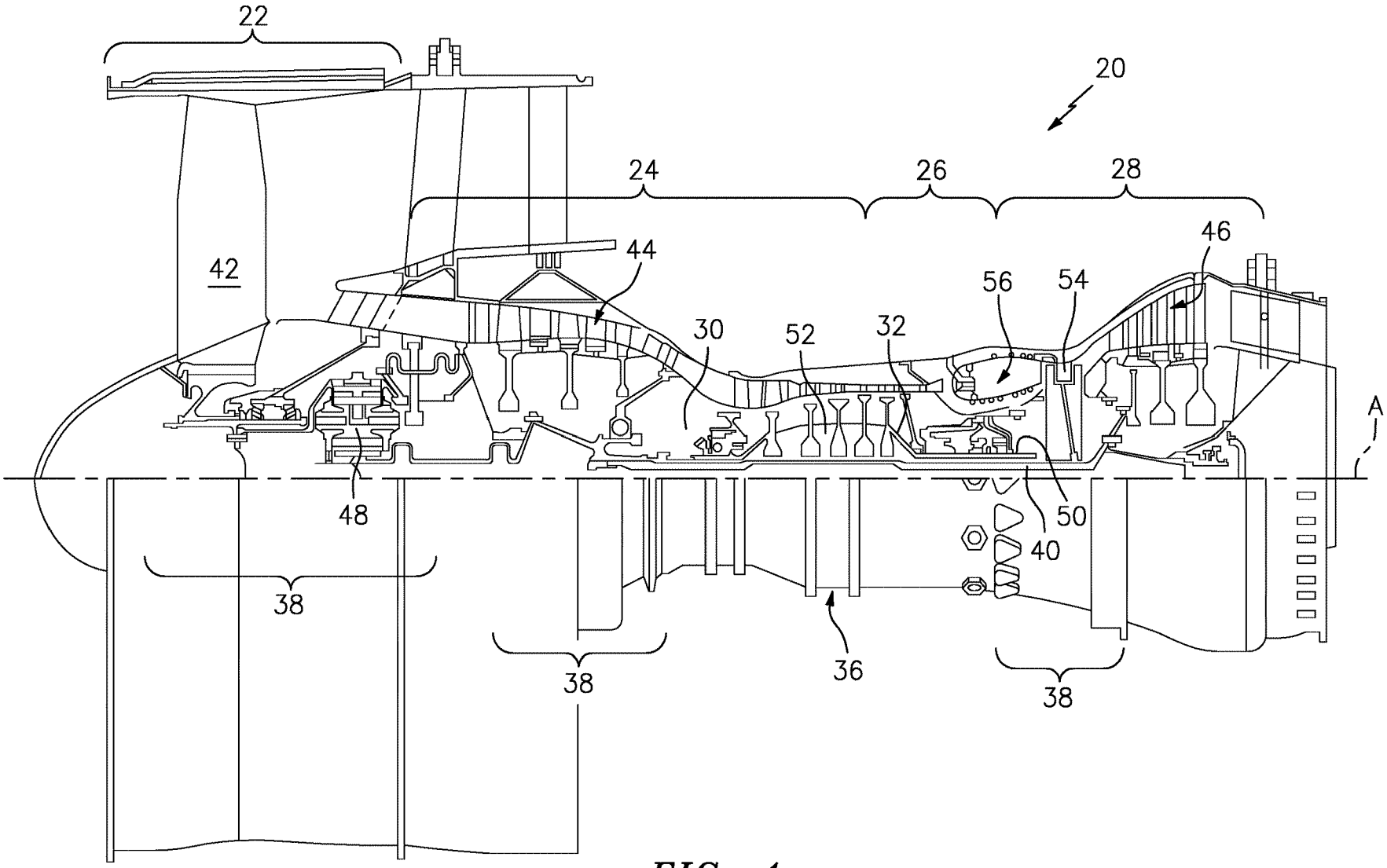
FIG. 1 is a schematic cross-section of an example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein are not limited to use with turbofans as the teachings may be applied to other types of turbine engine architectures such as turbojets, turboshafts, and three-spool (plus fan) turbofans.

The engine 20 generally includes a low spool 30 and a high spool 32 mounted for rotation about an engine central longitudinal axis A relative to an engine case structure 36 via several bearing structures 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 46, 54 rotationally drive the respective low spool 30 and high spool 32 in response to the expansion. The main engine shafts 40, 50 are supported at a plurality of points by bearing structures 38 within the engine case structure 36.

Figure 2:
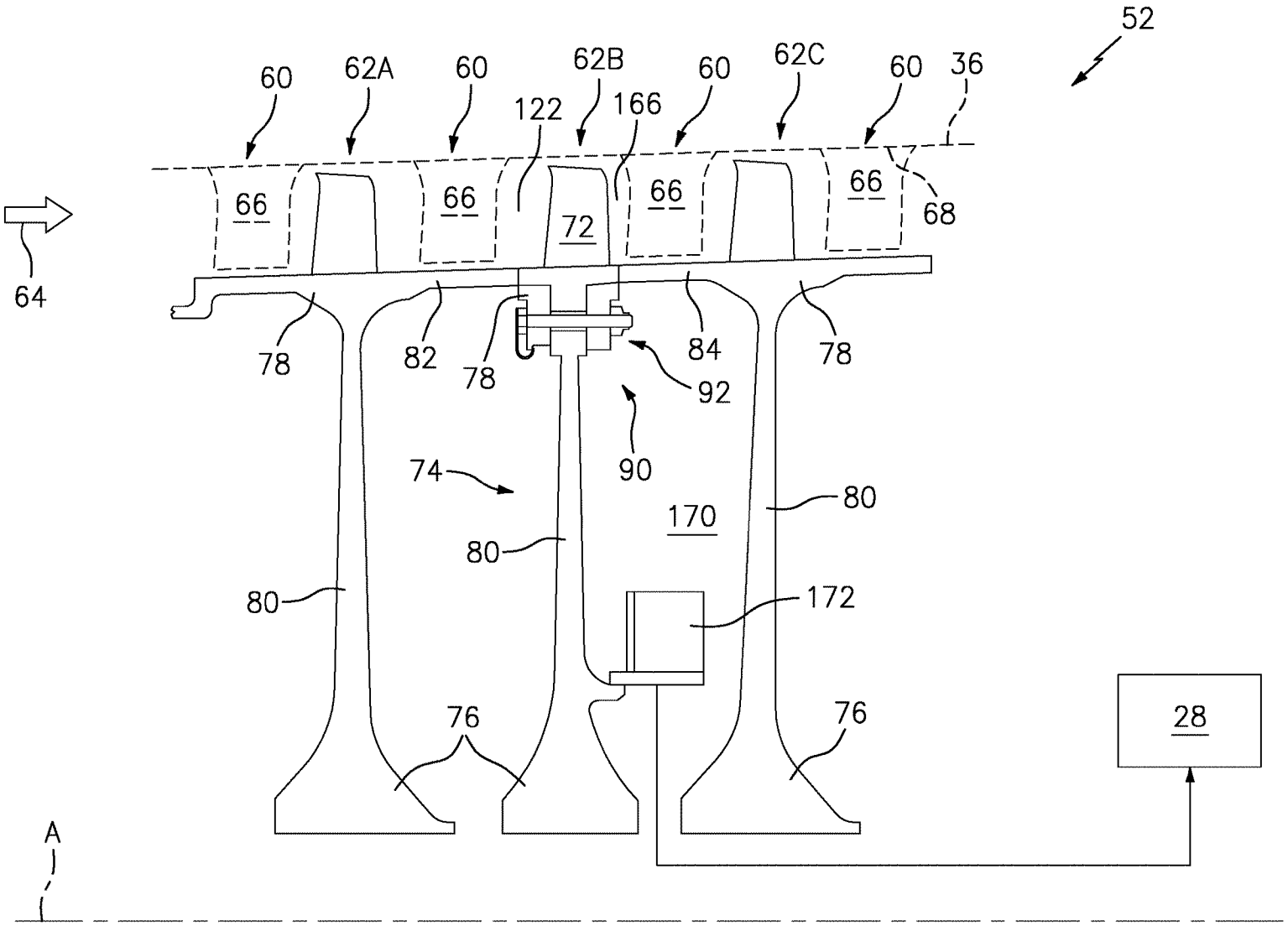
FIG. 2 is an enlarged schematic cross-section of an engine compressor section including a bolted attachment that provide airflow metering.

With reference to FIG. 2, the HPC 52 includes a multiple of stages with alternate stationary vane arrays 60 and rotor disks 62 along an airflow path 64. The rotor disks 62 may be assembled in a stacked configuration in which one or more of the rotor disks 62 may be bolted together in a stacked configuration to generate a preload that compresses and retains the HPC rotor disks 62 together as a spool. Although the HPC 52 is illustrated in the disclosed non-limiting embodiment, other engine sections will also benefit herefrom. Moreover, although a particular number of stages are illustrated, it should be appreciated that any number of stages will benefit herefrom.

Each vane array 60 includes a multiple of cantilevered mounted stator vane airfoils 66 that extend in a cantilever manner from an outer platform 68 toward the engine central longitudinal axis A. The outer platform 68 is mounted to the engine static structure 36 such as an engine case via, for example, segmented hooks or other interfaces.

Particular rotor disks may be a pancake rotor 62B that includes a multiple of blades 72 integrally mounted to a respective rotor disk 74 that is sandwiched between respective flanged rotor disks 62A, 62B.

The rotor disks 62A, 62B, 62C generally includes a hub 76, a rim 78, and a web 80 that radially extends therebetween. The rim 78 of rotor disks 62A, 62C include respective axially extending rotor spacer arms 82, 84 that respectively extend axially aft and axially forward with respect to the pancake rotor 62B to provide an interface 90 that spaces the adjacent rotor disks axially therefrom. It should be appreciated that rotor disks of various configurations with, for example, a single rotor spacer arm will also benefit herefrom.

An interface 90 between the pancake rotor 62B and the adjacent rotor disks 62A, 62C is formed as a bolted interface with a multiple of fastener assemblies 92 (one shown). The multiple of fastener assemblies 92 are each located along a fastener axis T arranged in a circle around the engine axis A.

Figure 3:
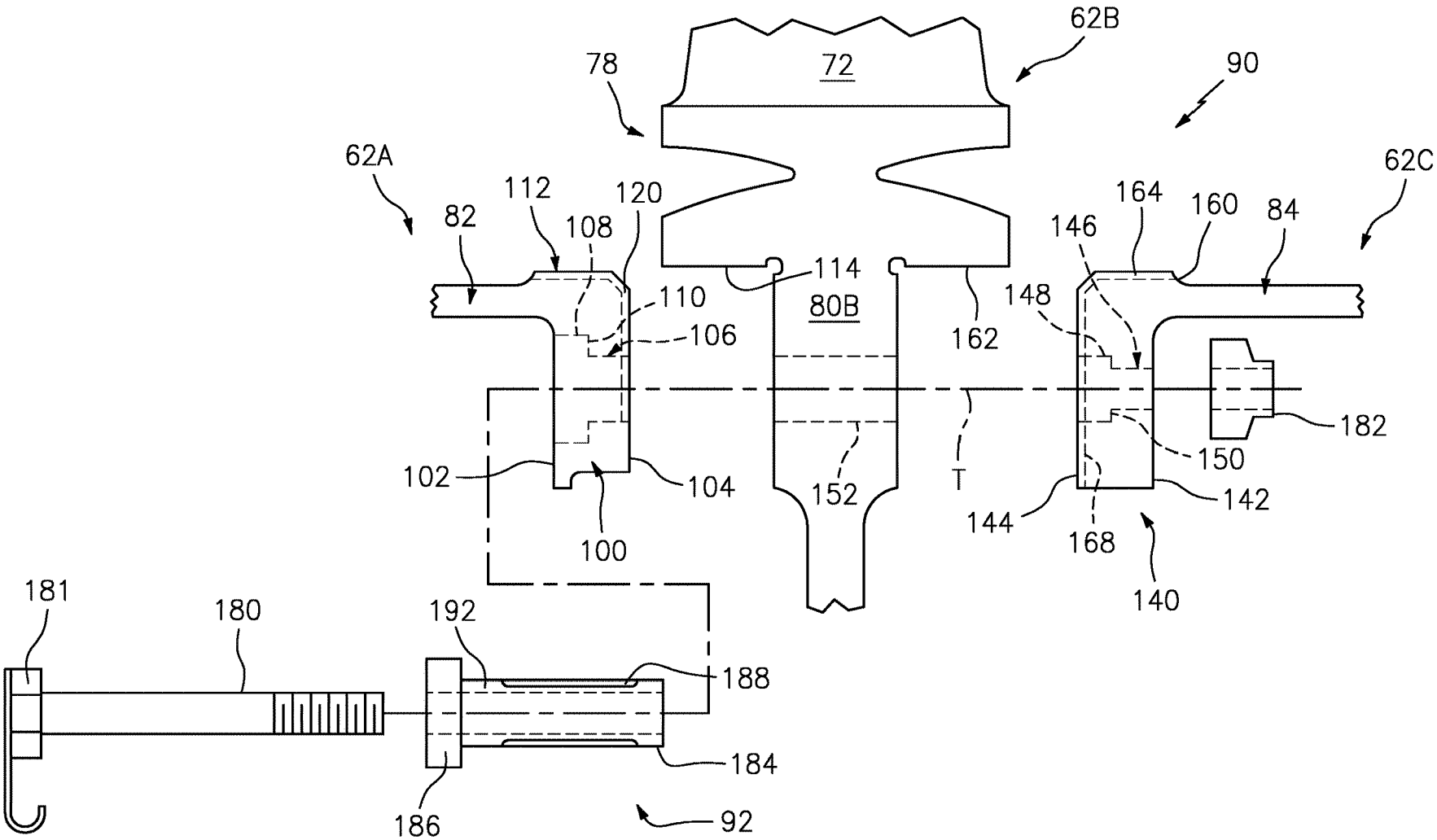
FIG. 3 is an exploded view of the bolted attachment that provide airflow metering.

With reference to FIG. 3, the forward rotor disk 62A which is illustrated as the disk forward of the pancake rotor 62B includes the aft axially extending rotor spacer arm 82 with an aft flange 100. The aft flange 100 has an outboard flange surface 102 and an inboard flange surface 104. A first hole 106 along the axis T may be formed with a counterbore 108 in the outboard flange surface 102. The counterbore 108 forms a major diameter with a step surface 110 transverse to the axis T greater than the diameter of the first hole 106.

The aft flange 100 includes a disk surface 112 that abuts an inner disk surface 114 of the pancake rotor 62B. The inboard flange surface 104 abuts the web 80B of the pancake rotor 62B. The disk surface 112 and the inboard flange surface 104 include a multiple of grooves 120 (e.g., "fingernail" cuts; one shown). The multiple of grooves 120 (also shown in FIG. 4) provide an airflow communication path from a plenum 122 (FIG. 4) forward of the blades 124 of the pancake rotor 62B to the first hole 106.

The aft rotor disk 62C, which is illustrated as the disk aft of the pancake rotor 62B, includes the forward axially extending rotor spacer arm 84 with a forward flange 140. The forward flange 140 has an outboard flange surface 142 and an inboard flange surface 144. A third hole 146 along the axis T is formed with a counterbore 148 in the inboard flange surface 144. The counterbore 148 forms a major diameter with a step surface 150 transverse to the axis T greater than the diameter of the first hole 106. The counterbore 148 diameter is equivalent to the diameter of the first hole 106 and a second hole 152 in the web 80B of the pancake rotor 62B.

The forward flange 140 includes a disk surface 160 that abuts an inner disk surface 162 of the pancake rotor 62B. The inboard flange surface 144 abuts the web 80B of the pancake rotor 62B. The disk surface 160 and the inboard flange surface 144 include a multiple of grooves 164 (e.g., "fingernail" cuts; one shown). The multiple of grooves 164 provide an airflow communication path from a plenum 166 (FIG. 4) aft of the blades 124 of the pancake rotor 62B to the counterbore 148. A multiple of outlet grooves 168 (one shown) between the web 80B of the pancake rotor 62B extend from the counterbore 148 to an inner plenum 170 (FIG. 4) that may contain an anti-vortex tube system 172 (also shown in FIG. 2).

Figure 5:
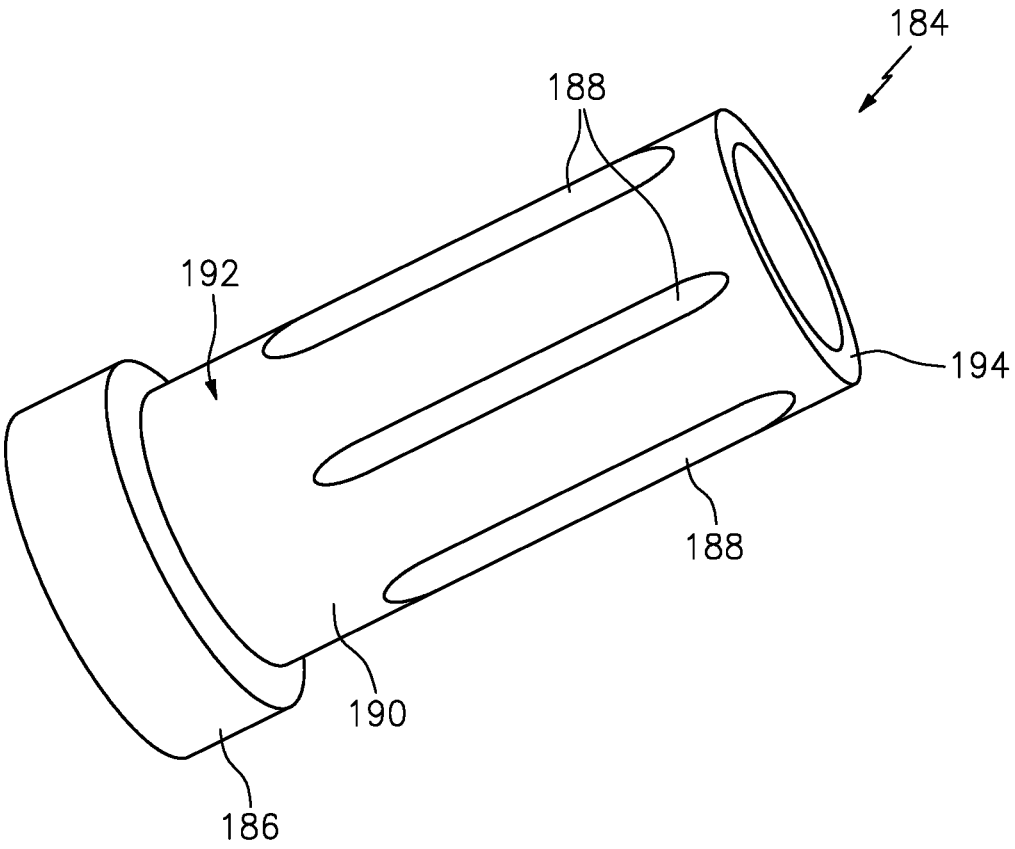
FIG. 5 is a perspective view of a bushing for the bolted attachment.

Each of the multiple of fastener assemblies 92 includes a bolt 180, a nut 182 and a bushing 184. The bushing 184 includes a flange 186 and a multiple of grooves 188 along an outer surface 190 of the tubular body 192 (FIG. 5). The bushing 184 extends through the first hole 106, the hole 152 in the web 114 of the pancake rotor 62B, and into the counterbore 148 in the inboard flange surface 144 along the axis T. Alternatively, the counterbore 148 is not required and the bushing may stop short of flange 144 and still function.

Figure 4:
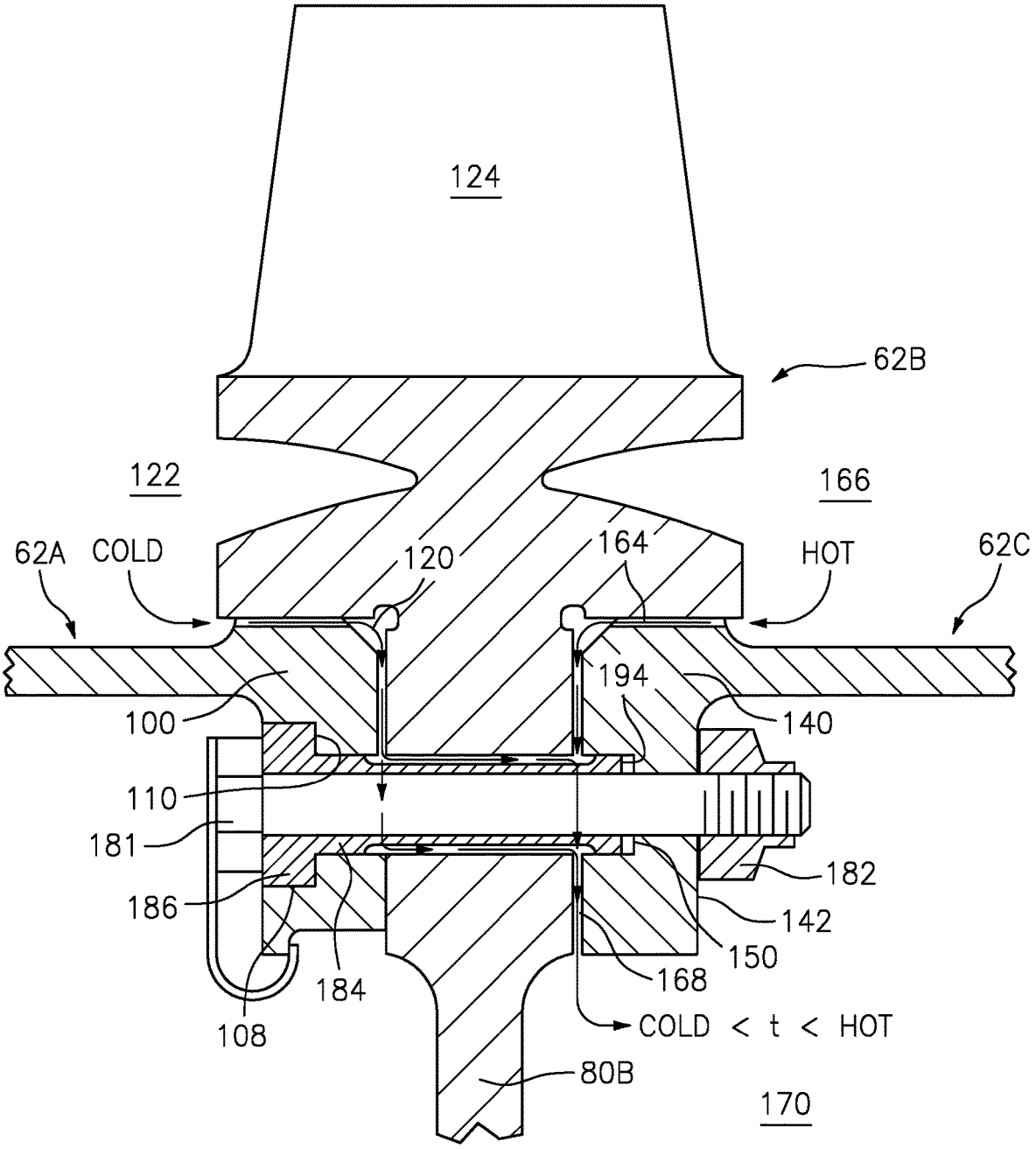
FIG. 4 is a perspective view of the bolted attachment in an assembled condition.

With reference to FIG. 4, an end 194 of the bushing 184 does not contact the step surface 150 such that the web 80B of the pancake rotor 62B is sandwiched between the aft flange 100 of the forward rotor disk 62A and the forward flange 140 of the aft rotor disk 62C. The bolt head 181 of the bolt 180 abuts the flange 186 of the bushing 184 which then abuts the step surface 110 of the counterbore 108. The nut 182 contacts the outboard flange surface 142 of the aft rotor disk 62C such that the bushing 184 does not limit surface contact between the inboard flange surface 144 and the web 80B of the pancake rotor 62B. That is the end 194 of the bushing 184 does not axially contact with the aft flange such that the bushing 184 does not interfere with the bolted rotor stack.

The multiple of fastener assemblies 92 permit a desired mixture of the hot-side airflow from the plenum 122 forward of the blades 124 and the cold-side airflow from the plenum 166 aft of the blades 124 into the inner plenum 170 that may contain the anti-vortex tube system 172. The mixed airflow from the inner plenum 170 may then be communicated downstream for use in, for example, the turbine section 28. In one example, the hot-side airflow is 100-200 degree F. higher than that of the cold-side airflow.

The multiple of fastener assemblies 92 permit mixing of the cold-side and hot-side air to more precisely control the secondary air flow temperature to better suit the needs of both the turbine section for cooling and the compressor section for conditioning stress and tip clearances.

Although particular step sequences are shown, described, and claimed, it should be appreciated that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason, the appended claims should be studied to determine true scope and content.

What is claimed is:

1. A rotor stack for a gas turbine engine, comprising:

a first rotor disk with a first rotor spacer arm, the first rotor spacer arm having a first flange with an outboard flange surface and an inboard flange surface, a first hole along an axis through the first flange;

a second rotor disk with a web having a second hole along the axis;

a third rotor disk with a third rotor spacer arm, the third rotor spacer arm having a third flange with an outboard flange surface and an inboard flange surface, a third hole along the axis through the third flange; and a bushing with a tubular body and a flange that extends therefrom, the tubular body comprising at least one axial groove along an outer diameter thereof, the bushing extending through the first hole, the second hole, in the inboard flange surface of the third flange.

2. The rotor stack as recited in claim 1, further comprising, a fastener that extends through the bushing along the axis.

3. The rotor stack as recited in claim 2, further comprising, a nut threaded to the fastener to sandwich the web between the first flange and the third flange.

4. The rotor stack as recited in claim 1, wherein the first hole comprises a first counterbore in the outboard flange surface, a cold-side groove from an outboard plenum along the inboard flange surface to the first counterbore in the outboard flange surface.

5. The rotor stack as recited in claim 4, further comprising, a hot-side groove along the inboard flange surface of the third flange to a counterbore in the third hole of the inboard flange surface of the third flange.

6. The rotor stack as recited in claim 5, further comprising the counterbore in the third hole in the inboard flange surface of the third flange, the bushing extending through the first hole, the second hole, and partially into the counterbore in the third hole, an output groove along the inboard flange surface of the third flange from the counterbore in the third hole of the inboard flange surface of the third flange to an inner plenum.

7. The rotor stack as recited in claim 6, wherein the hot-side groove and the cold-side groove are sized to provide a predetermined temperature flow to the output groove.

8. The rotor stack as recited in claim 6, wherein the hot-side groove provides an airflow that is 100-200 degree F. higher than an airflow from the cold-side groove.

9. The rotor stack as recited in claim 8, wherein the hot-side groove provides an airflow that is at a higher pressure than an airflow from the cold-side groove.

10. The rotor stack as recited in claim 1, wherein the second rotor disk is a pancake disk.

* * * * *